US008091322B2

(12) United States Patent
Ehrmann et al.

(10) Patent No.: US 8,091,322 B2
(45) Date of Patent: Jan. 10, 2012

(54) PACKAGING MACHINE AND METHOD FOR PRODUCING PACKAGES MADE OF A FILM

(75) Inventors: Elmar Ehrmann, Bad Gronenbach (DE); Herbert Kirmse, Wolfertschwenden (DE)

(73) Assignee: MULTIVAC Sepp Haggenmueller GmbH & Co. KG (DE)

( * ) Notice: Subject to any disclaimer, the term of this patent is extended or adjusted under 35 U.S.C. 154(b) by 223 days.

(21) Appl. No.: 12/217,291

(22) Filed: Jul. 2, 2008

(65) Prior Publication Data

US 2009/0071100 A1 Mar. 19, 2009

(30) Foreign Application Priority Data

Jul. 6, 2007 (DE) ..... 10 2007 031 527

(51) Int. Cl.
*B65B 47/08* (2006.01)
*B65B 9/04* (2006.01)
*B65B 57/00* (2006.01)

(52) U.S. Cl. ..... 53/433; 53/453; 53/559; 53/511

(58) Field of Classification Search ..... 53/427, 53/432, 433, 453, 510, 511, 559; 425/405.1; 251/65, 129.4, 129, 5, 129.8
See application file for complete search history.

(56) References Cited

U.S. PATENT DOCUMENTS

| | | | | | |
|---|---|---|---|---|---|
| 3,694,991 | A * | 10/1972 | Perdue et al. | 53/427 |
| 3,714,754 | A | 2/1973 | Holcombe et al. | |
| 3,830,365 | A * | 8/1974 | Krueger et al. | 53/427 |
| 3,972,155 | A * | 8/1976 | Mahaffy et al. | 53/427 |
| 4,285,639 | A * | 8/1981 | Woodring et al. | 417/218 |
| 4,567,713 | A * | 2/1986 | Natterer | 53/433 |
| 4,666,394 | A * | 5/1987 | Wakamiya et al. | 425/342.1 |
| 4,713,047 | A | 12/1987 | Klinkel | |
| 5,125,216 | A * | 6/1992 | Redaelli | 53/550 |
| 5,603,203 | A * | 2/1997 | Robache | 53/559 |
| 6,067,778 | A * | 5/2000 | Yamamoto et al. | 53/451 |
| 6,074,203 | A * | 6/2000 | Leturmy et al. | 432/47 |
| 6,283,145 | B1 * | 9/2001 | Fenn | 137/489 |
| 6,314,991 | B1 * | 11/2001 | Gill | 137/486 |
| 6,579,082 | B2 * | 6/2003 | Castellari | 425/150 |
| 6,748,721 | B2 * | 6/2004 | Kodai | 53/559 |
| 7,070,161 | B2 * | 7/2006 | Piehl et al. | 251/129.04 |
| 2001/0028124 | A1 | 10/2001 | Anderson et al. | |
| 2004/0065048 | A1 * | 4/2004 | Kondo et al. | 53/75 |

FOREIGN PATENT DOCUMENTS

| | | | |
|---|---|---|---|
| DE | 3404451 | A1 * | 8/1985 |
| DE | 10 2005 061 315 | A1 | 6/2007 |
| EP | 0 192 605 | A1 | 8/1986 |
| EP | 0 461 689 | A1 | 12/1991 |
| EP | 569934 | B1 * | 10/1996 |
| GB | 1 445 530 | | 8/1976 |
| WO | WO-2007071298 | | 6/2007 |

OTHER PUBLICATIONS

Machine translation of DE 3404451, retrieved from EPO website http://translationgateway.epo.org/emtp/gw/?ACTI...MAT=docdb &COUNTRY=DE&NUMBER=3404451&KIND=A1&T=1, 4 pages, Oct. 21, 2010.*

(Continued)

*Primary Examiner* — Stephen F Gerrity
(74) *Attorney, Agent, or Firm* — Brooks Kushman P.C.

(57) ABSTRACT

The invention relates to a packaging machine comprising at least one working station, in which a film is acted upon by means of underpressure or overpressure, characterized in that the pressure and/or the volume flow is regulated by means of a proportional controller.

25 Claims, 8 Drawing Sheets

OTHER PUBLICATIONS

Machine translation of EP 569934, retrieved from EPO website http://translationgateway.epo.org/emtp/gw/?ACTI...MAT=docdb &COUNTRY=EP&NUMBER=0569934&KIND=A1&T=1, 2 pages, Mar. 23, 2011.*

European Patent Office official communication dated Oct. 19, 2009—Application No. 08 011 950.6—2308—Applicant, Multivac Sepp Haggenmueller GmbH & Co. KG—4 Pages.

* cited by examiner

PACKAGING MACHINE AND METHOD FOR PRODUCING PACKAGES MADE OF A FILM

BACKGROUND

The present invention relates to a packaging machine and to a method for producing packages made of a film.

In packaging machines and in particular in the forming and sealing stations of the packaging machine, pressure must be provided for the heating of the film, the forming of the film and the sealing of the package. In conventional systems, the pressure is hereby controlled via manually settable filling times or manual pressure controllers, that is, a certain pressure is generated for a predetermined period of time via the opening of a valve. The pressure is thereby subject to fluctuations and a reproducibility is not given. This is disadvantageous in particular because different types of packaging and films in a packaging machine require different settings so that the reproducibility is important.

Furthermore, the valves comprising manual pressure controllers previously used for the gassing of packages require a backpressure, which often builds up too late for a rapid control process, in particular with small chambers and which thus causes the package to inflate.

The use of proportional controllers, which comprise a measuring and control engineering, is not common in packaging machines, because they increase the pressure too slowly. Conventional proportional controllers cannot completely open the valve in particular at the onset of the control, because there is a risk of increasing the pressure too much. They are thus too slow. Material stress limits can furthermore be exceeded.

SUMMARY

It is the object of the invention to provide an improved packaging machine and an improved method for producing packages made of a film, which avoid the above-mentioned disadvantages.

An advantage of the packaging machine and of the method for producing packages made of a film, respectively, is the reproducibility of the parameters, which are set so as to be specific to the packaging. The control via the proportional controller can be used for different working stations of a packaging machine, such as forming station, sealing station, etc. In addition, the controller can, at the same time, be used as a valve, wherein one component can be saved as compared to the conventional systems, which require a valve and a pressure controller.

A further advantageous use of the invention occurs in response to the gassing process. It is possible with the method and the device according to the invention, respectively, to realize a slight increase of the volume flow into the package and thereafter a sharp increase so as to keep the package from inflating, caused by the initial lack of backpressure and the accompanying belated control.

A further advantage of the invention is the quality control, which is made possible by the reproducibility of the process. There are no possibilities for errors due to the capability of setting pressures manually. The required values can be stored as a function of the process and can be recalled therewith automatically. The control/regulating system ensures that the same pressure is present in the device during the entire process time.

Further features and advantages of the invention can be seen from the description of exemplary embodiments by means of the enclosed drawings.

DETAILED DESCRIPTION

Figure 1:
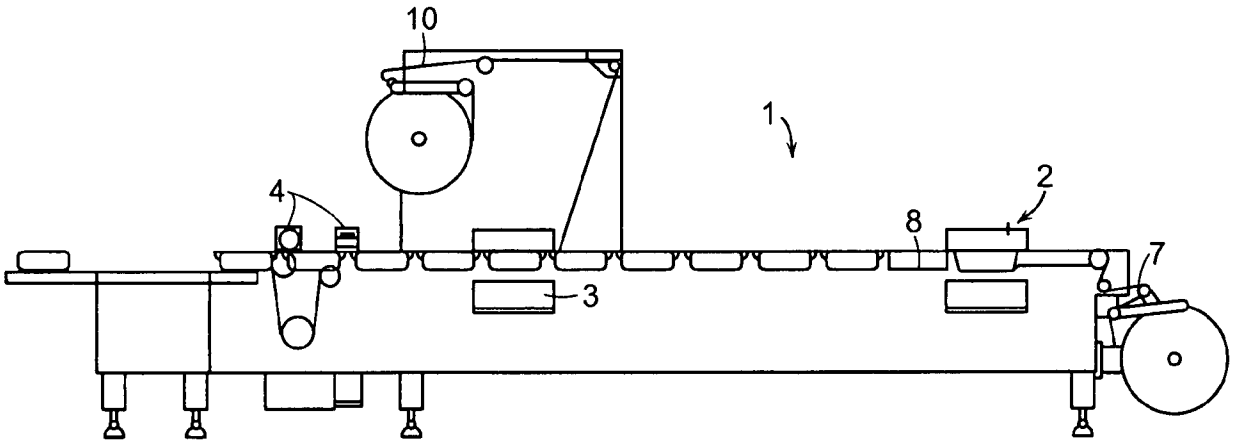
FIG. 1 shows a schematic side view of a packaging machine comprising a forming, sealing and cutting station.

As can be seen from FIG. 1, a packaging machine 1 according to an embodiment comprises one or a plurality of forming stations 2, one or a plurality of evacuation and sealing stations 3 and a cutting station 4. At the inlet side, an inlet for a lower film 7 is provided, which is guided through the stations to the end at the outlet side starting at the inlet side. A forming of containers 8 takes place in the known manner in the forming station 2 by means of deep-drawing. These containers 8 are subsequently filled with the merchandise, which is to be packaged. In front of the inlet to the evacuation and sealing station 3, a top film 10 is guided to the upper side of the lower film 7 in front of the inlet to the evacuation and sealing station 3, quasi as a lid for the containers 8. In the evacuation and sealing station 3, the deep-drawn package is evacuated and sealed. In the cutting station 4, the packages are separated at last.

Figure 2:
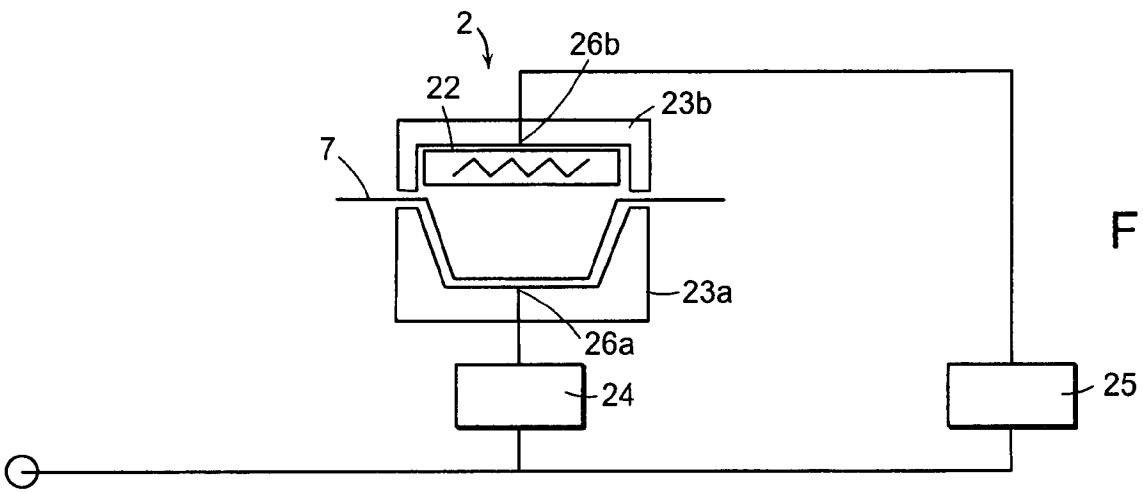
FIG. 2 shows a schematic view of a forming station comprising the pressure control according to the invention.

The forming station 2 will be described below by means of FIG. 2. The forming station 2 comprises a chamber upper part 23*b* and a chamber lower part 23*a*, as well as a heating plate 22 provided in the upper chamber part 23*b*. The chamber lower part 23*a* as well as the chamber upper part 23*b* is in each case connected to a compressed air supply 26*a* and 26*b*, respectively, which in turn are connected to a pressure source 27 for providing overpressure or underpressure. A proportional controller 24 and 25, respectively, is connected upstream of each compressed air supply. The lower film 7 can be clamped between the chamber lower part 23*a* and the chamber upper part 23*b* and can be heated by means of the heating plate 22. This process requires a defined pressure to prevent imprints and haze to the film. The pressure is generated via the proportional controller 24. The proportional controller 25 serves the purpose of applying a defined pressure to the chamber lower part for forming the lower film.

Figure 3:
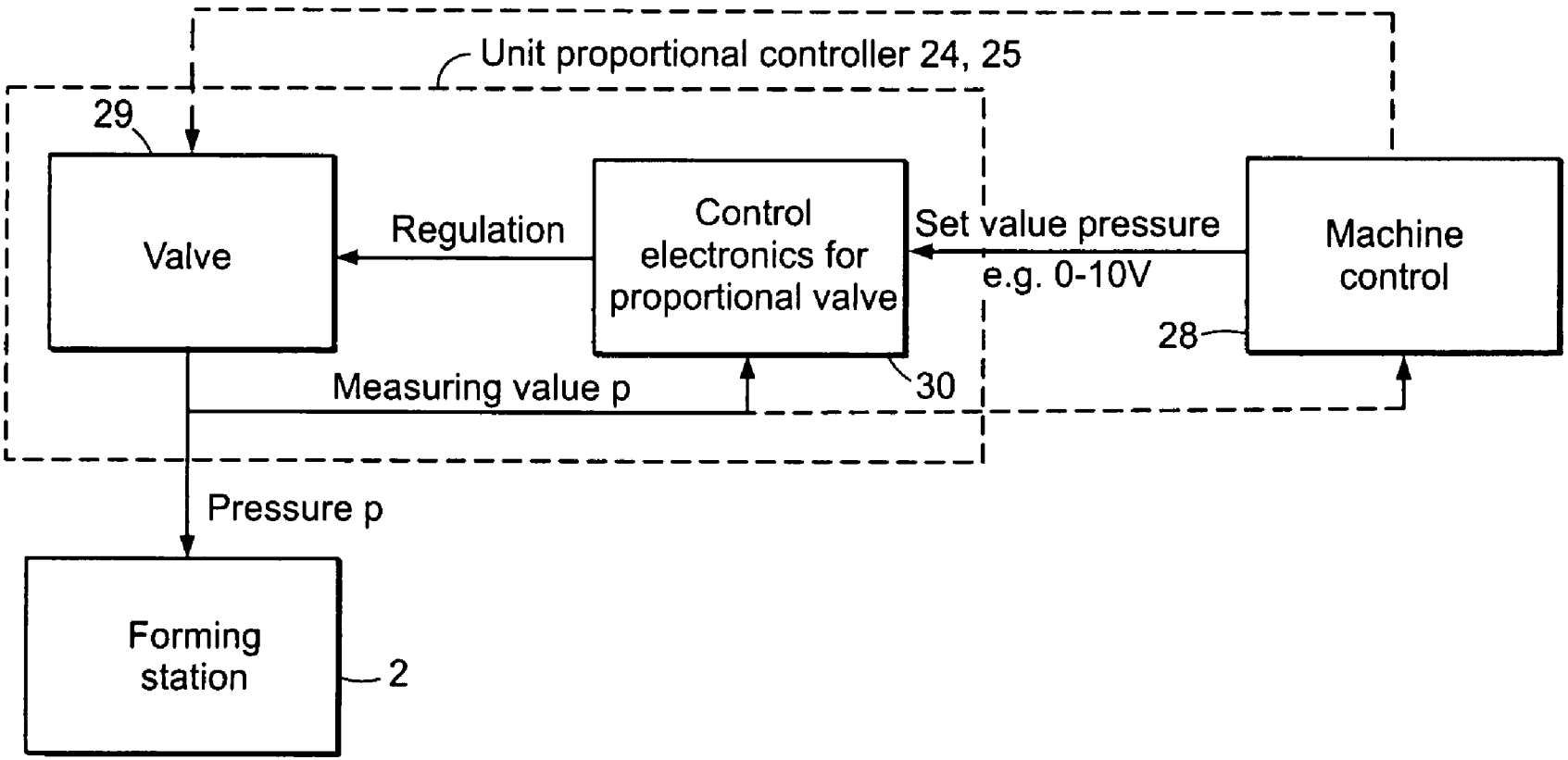
FIG. 3 shows a schematic block diagram of the proportional controller and of the control.

FIG. 3 shows the connection between the proportional controller 24 and 25, respectively, of a machine control 28 and the forming station 2. The proportional controller 24 and 25, respectively, comprises a valve 29 and a control electronics 30 for the valve. The machine control 28 is embodied in such a manner that it supplies a voltage value, e.g. 0-10 V, which corresponds to a desired pressure, to the control electronics 30 of the proportional controller 24, 25. The control electronics 30 controls the valve 29 to adapt the actual pressure, which is measured in the working station by means of a measuring device, to the predetermined set value. During the programming of the control software, pressures and valve cross sections, respectively, are assigned to different voltage potentials. The mechanical components of the system are controlled by means of the applied voltage. With the flow rate of the valve, the pressure also changes accordingly according to the law p=F/A (pressure=force/area).

The forming station 2 serves the purpose of forming containers made of a film by means of compressed air and/or by means of a vacuum with or without a stamp. The film 7 is clamped for the purpose of forming and is initially heated at the heating plate 22. Subsequently, the film is molded during the forming process by means of a set pressure and/or by means of a vacuum with or without a stamp as rapidly as possible and thus with an even wall thickness and a slight cooling. The set pressure thereby substantially determines the result as a function of the film thickness, draw depth and container shape. Preferably, the control takes place in such a manner that, at the onset of the deformation, the valve is briefly opened completely so as to attain the fastest possible deformation and so as to then limit and readjust the pressure.

The production of a package will be described below by means of FIG. 1 and FIG. 2 in an exemplary manner. Initially, the lower film is deformed in the forming station 2 so that a container is created. In the forming station 2, the lower film 7 is initially clamped between chamber lower part 23*a* and chamber upper part 23*b*. In the next step, the overpressure provided by the proportional controller 24 pushes the film in the direction of the heating plate 22 and is heated by it. Subsequently, the film is deformed by the overpressure provided by the proportional controller 25 in the direction of the chamber lower part 23*a*. The film thereby cools down, the shape of the package remains. The set pressure thereby substantially determines the result as a function of film thickness, draw depth and container shape.

The pressures in the forming device 2 are set by means of the electronic proportional controllers 24, 25 in the method according to the invention for producing packaging made of a film. The pressures can be set via a machine display and can be stored as a function of the process. The pressure currently available in the device will be accommodated by means of the control and regulating system integrated in the proportional controller and can thus be reproduced. The control can also be carried out by the machine control 28.

The forming station is brought to the set pressure, which is required for the deformation, in a relatively short period of time by means of the proportional controller 24, 25 and is held at this pressure until the film 7 cools down and deformation remains. Subsequently, the pressure is preferably released from the device into the atmosphere as fast as possible.

Subsequently, the container is filled (not illustrated) and is then closed in the sealing station 3 by means of the lid film 10 and is gassed beforehand, if applicable. Subsequently, the packages are separated in the cutting station 4.

With reference to FIGS. 4 to 6, the mode of operation of the proportional controller according to the invention will now be described in detail.

Figure 4A:
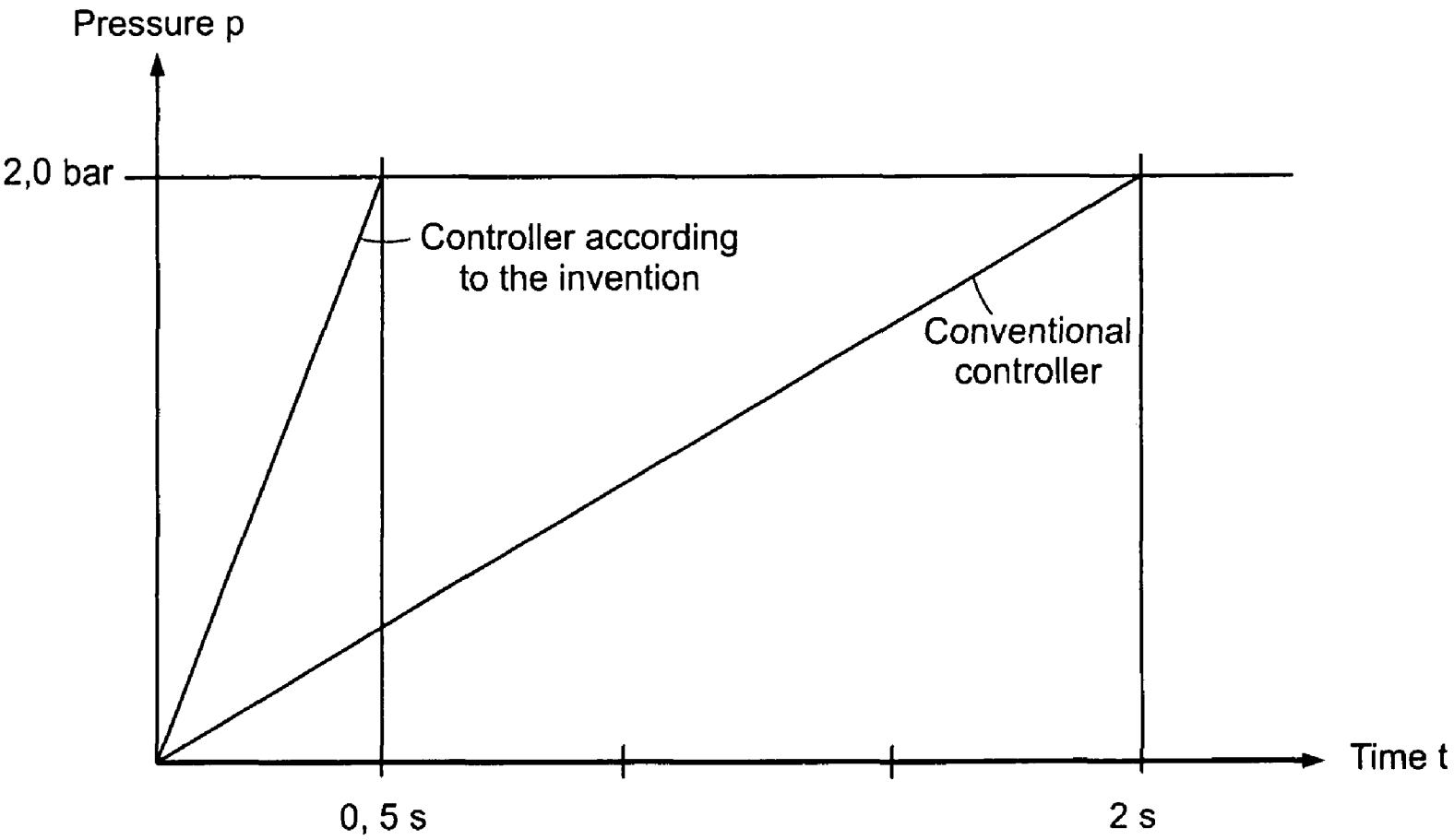
FIG. 4*a* shows a diagram for comparing a conventional pressure setting with the pressure setting according to the invention via the proportional controller.

FIG. 4*a* illustrates a comparison of the proportional controller according to the invention and a conventional proportional controller in a pressure/time diagram. The proportional controller according to the invention has a more rapid response time than the conventional controller. As can be seen from FIG. 4*a*, a slow control at the onset of the pressure change does not apply. A large filling volume allows for the pressure to increase rapidly; a careful control at the onset is thus not necessary. With reference to the maximum pressure, an optimization of the proportional controller is possible due to the known, relatively large volume of the region, which is to be gassed, filled or evacuated. This is attained by means of the electronic activation of the proportional controller. The required sensor system is located within the controller. The measuring and control system of the proportional controller or of the machine control 28 prevents an overpressure; in response to leakages, the pressure is readjusted.

Figure 4B:
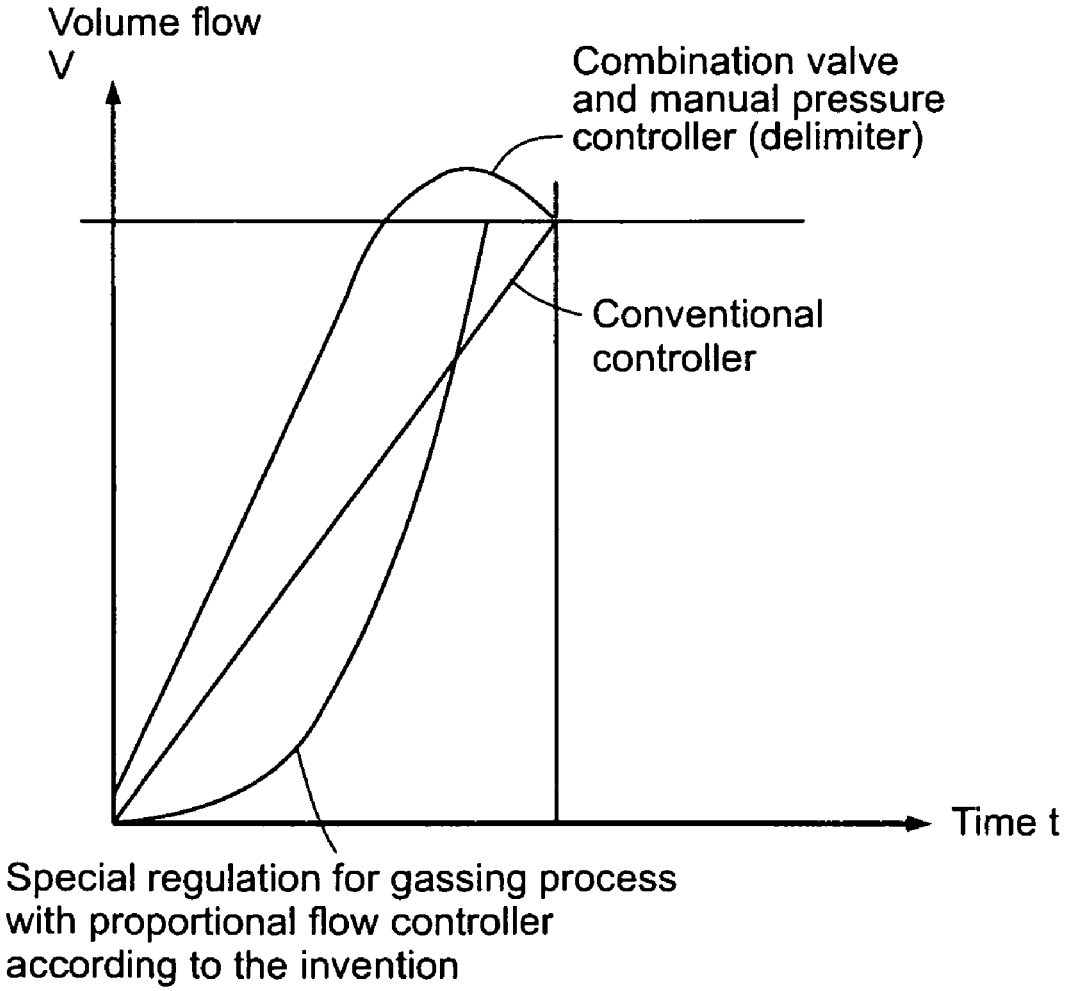
FIG. 4*b* shows a diagram for comparing a conventional proportional flow control with the proportional flow control according to the invention.

FIG. 4*b* shows the comparison of a conventional proportional controller, a combination of a valve and a manual pressure controller and a specific control for the gassing process by means of the proportional flow rate controller according to the invention in a volume flow/time diagram. According to the invention, a slight increase of the volume flow takes place hereby first prior to the sharp increase in the upper region of the diagram, so as to keep the package from inflating in particular with smaller chambers.

Figure 5A:
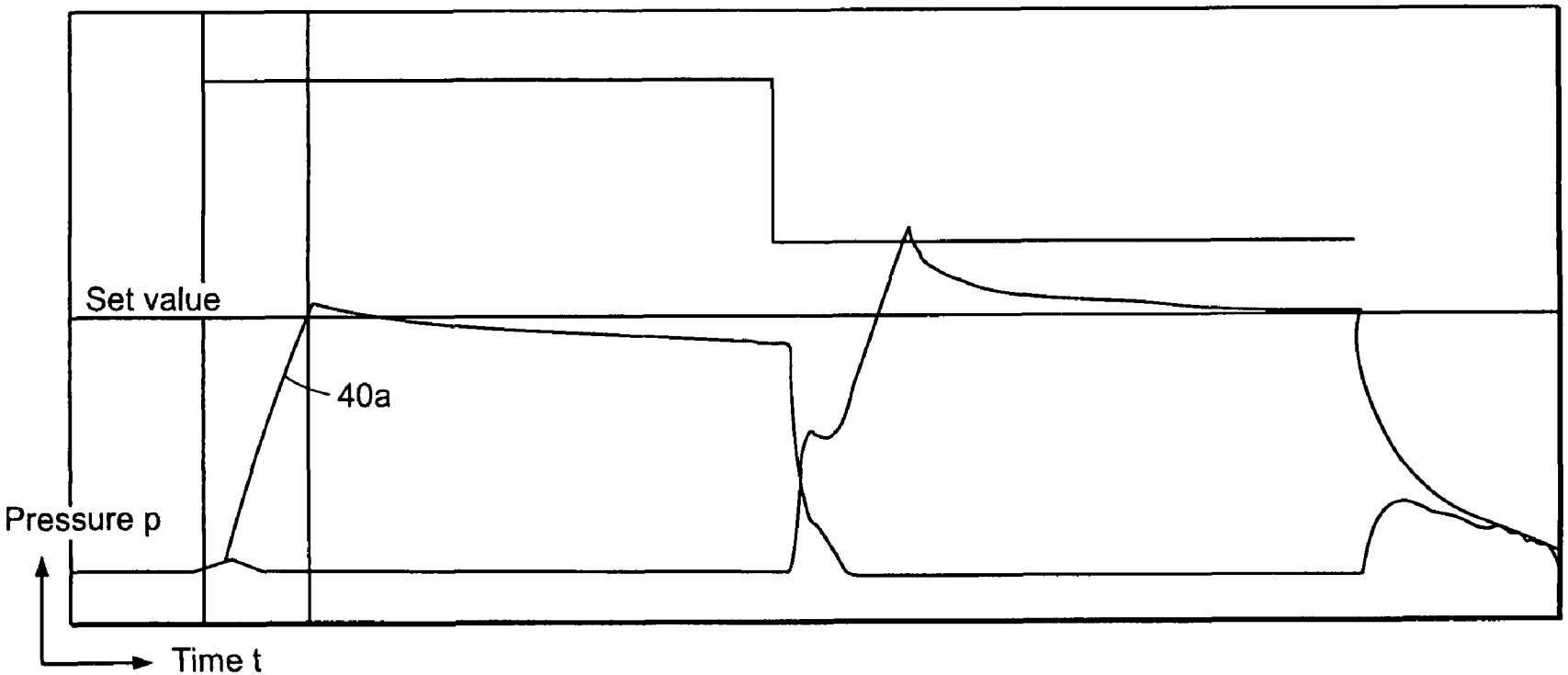
FIG. 5*a* shows a graph 40*a*, which shows the pressure build-up during the heating process without a proportional controller.

FIG. 5*a* (on the left-hand side of the image) shows the pressure build-up during the heating process without proportional controller by means of the graph 40*a*. The heating pressure initially rises above the set value and subsequently drops below the desired value due to leakage. A further disadvantage is that the desired pressure cannot be set but can only be attained with large deviation over the period t.

Figure 5B:
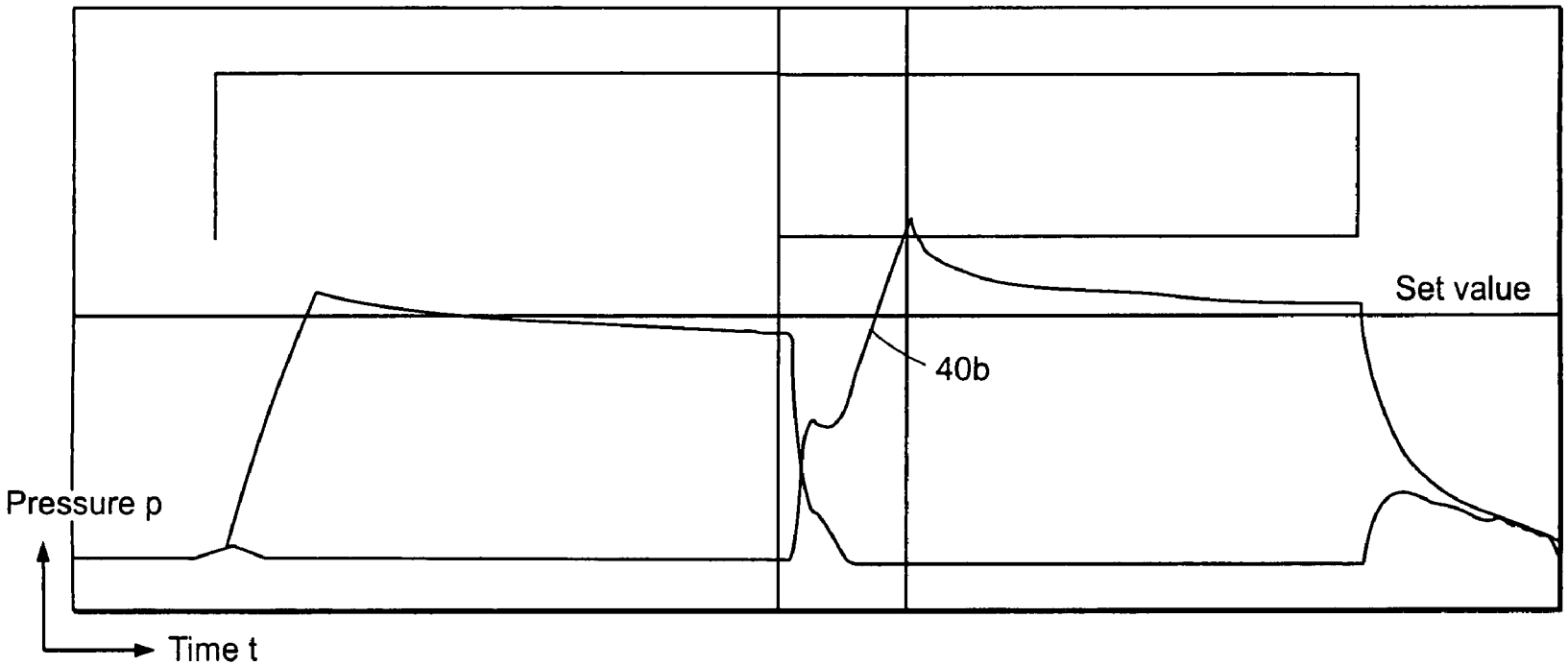
FIG. 5*b* shows a graph 40*b*, which shows the pressure build-up during the forming process without a proportional controller.

FIG. 5*b* (on the right-hand side of the image) shows the pressure build-up during the forming process without proportional controller by means of the graph 40*b*. The forming pressure initially rises just above the desired value (set value) and subsequently drops far below the desired value due to leakage. It is a disadvantage that the desired pressure cannot be set but that it can only be attained with large deviation over the period t.

Figure 6A:
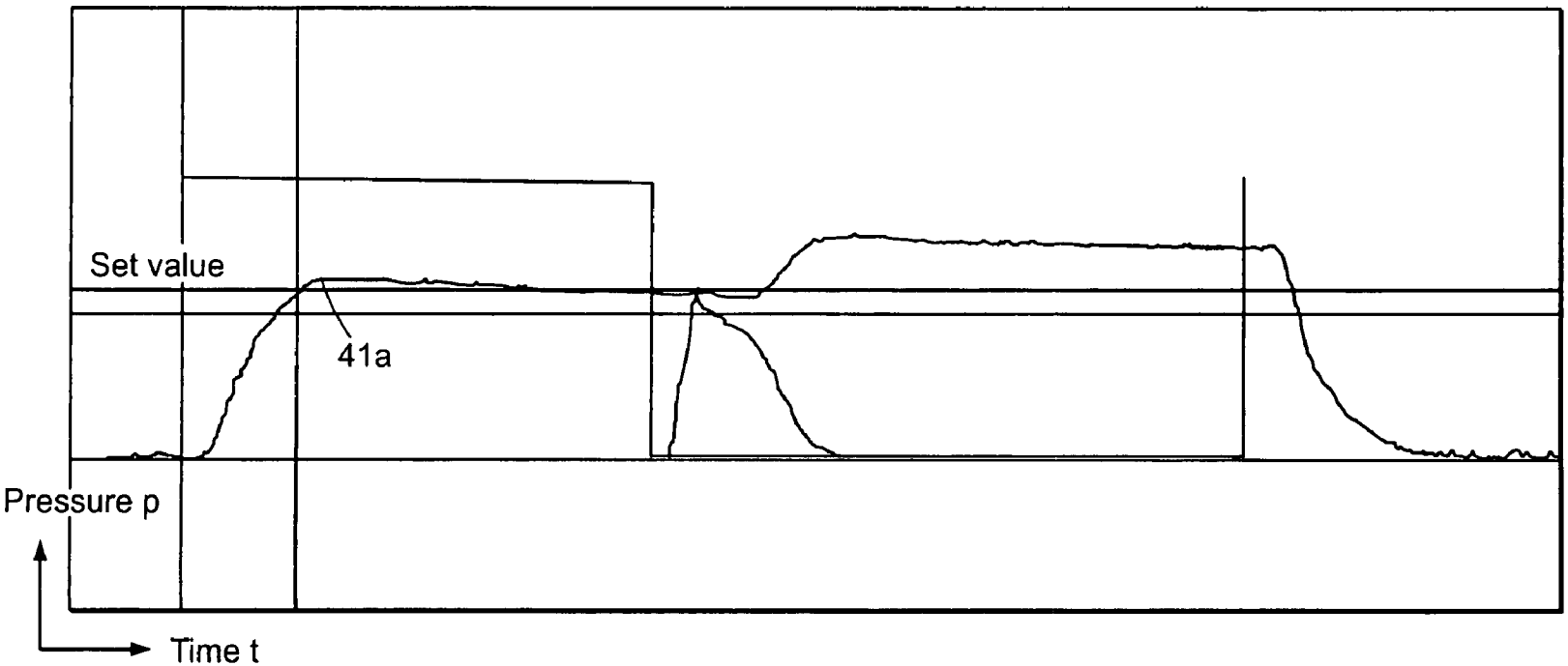
FIG. 6*a* shows a graph 41*a*, which shows the pressure build-up during the heating process with a proportional controller.

FIG. 6*a* (on the left-hand side of the image) shows the pressure build-up during the heating process with proportional controller by means of the graph 41*a*. The heating pressure rises to the desired set value. Overshooting lies within the tolerance zone. It then remains on the set pressure until the end of the set period regardless of possible leakages. It is an advantage that the desired pressure can be set via the operation terminal.

Figure 6B:
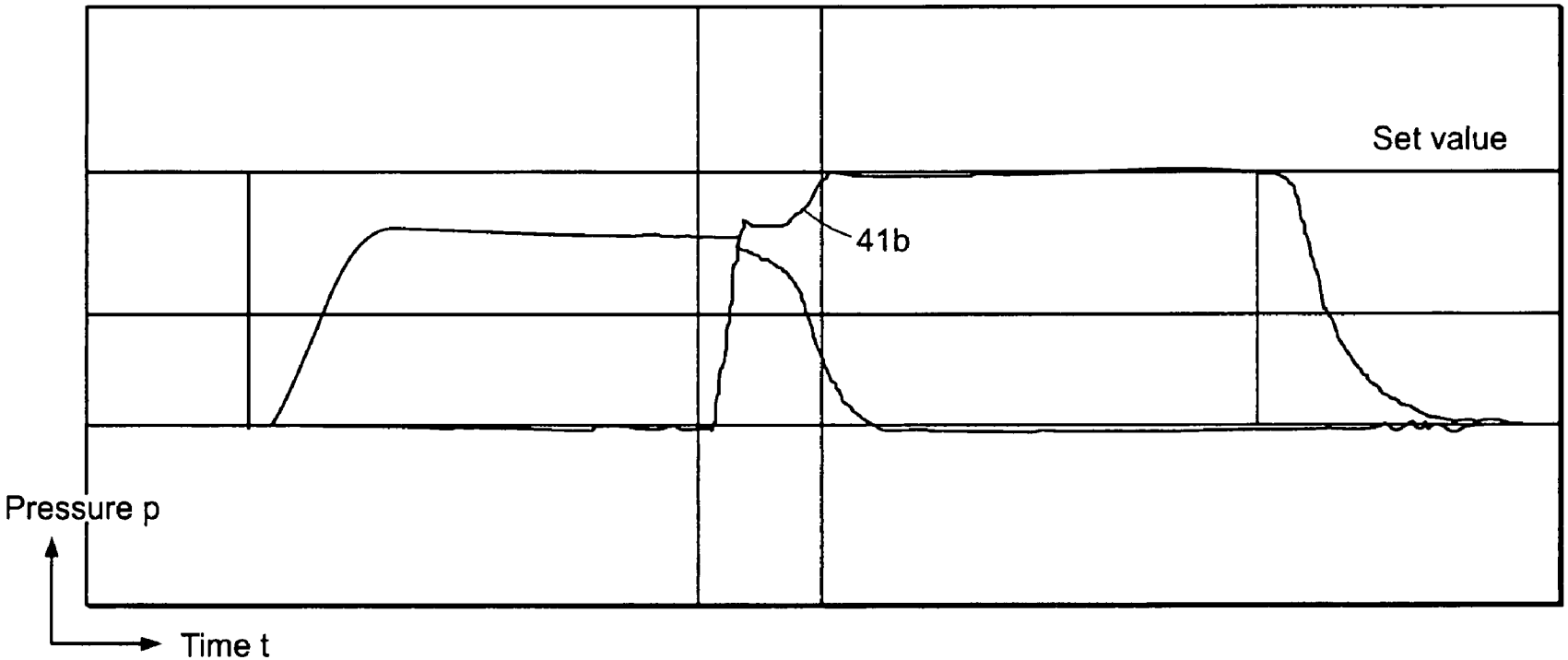
FIG. 6*b* shows a graph 41*b*, which shows the pressure build-up during the forming process with a proportional controller.

FIG. 6*b* (on the right-hand side of the image) shows the pressure build-up during the forming process with proportional controller by means of graph 41*b*. The forming pressure rises to the set value. Overshooting lies within the tolerance zone. It then remains on the set pressure until the end of the set period regardless of possible leakages. It is an advantage that the desired pressure can be set via the operation terminal.

The proportional controller is preferably used in the forming station, in which the film is formed for the packaging. However, all of the working stations of a packaging machine can be equipped with the device according to the invention and can operate according to the method according to the invention, respectively.

Upper part and lower part are pressed together by the provision of pressure and are then sealed during the operation of the sealing station. The pressure can be systematically built up and maintained by means of an air cushion.

A further example of the device according to the invention is a working station, which comprises a gassing device. An initially slight and later sharp increase of the volume flow is desirable hereby. The pressure is measured and controlled in all of the working stations and is accordingly also readjusted during the operation so as to attain an optimal result.

In addition, quick-action ventilating valves for the maximum pressure compensation with the environment can be provided. So as not to damage sensitive products, furthermore a throttle valve can be provided, so as to reduce the suction speed in vacuum. These components are already known from the state of the art. A variable flap control in the form of a proportional flow rate controller is also possible.

The invention claimed is:

1. A packaging machine comprising:

a forming station at which a film is acted upon to mold a container in the film, the forming station including a heating member;

a first proportional controller for developing a first underpressure or a first overpressure; and a second proportional controller that regulates a pressure and/or a volume flow of a gas to develop a second underpressure or a second overpressure;

wherein the forming station is configured to apply the first underpressure or the first overpressure to the film to move the film in a first direction toward the heating member, and wherein the forming station is configured to apply the second underpressure or the second overpressure directly to the film to move the film in a second direction different than the first direction to mold the container.

2. The packaging machine of claim 1, wherein the second proportional controller comprises a valve and control electronics, which regulate the valve as a function of a predetermined set pressure value and/or a set volume flow value and a measured actual pressure value and/or actual volume flow value of the gas.

3. The packaging machine according to claim 2, further comprising a machine control, wherein the second proportional controller is connected to the machine control, from which the second proportional controller receives a predetermined set pressure value and/or a set volume flow value of the gas or by means of which the second proportional controller is controlled.

4. The packaging machine according to claim 2, wherein the control electronics are structured and arranged in such a manner to briefly open the valve completely at the onset of deformation of the film and, then, to limit and readjust the pressure.

5. The packaging machine of claim 1, further comprising a machine control, wherein the second proportional controller is connected to the machine control, from which the second proportional controller receives a predetermined set pressure value and/or a set volume flow value of the gas or by means of which the second proportional controller is controlled.

6. The packaging machine according to claim 1, further comprising a display and a memory wherein a predetermined pressure and/or volume flow of the gas is set by means of the display and is stored in the memory.

7. The packaging machine according to claim 1, wherein the second proportional controller is structured and arranged in such a manner that the pressure and/or the volume flow can be readjusted during operation.

8. The packaging machine according to claim 1, wherein the second proportional controller is structured and arranged in such a manner to measure the pressure currently available in the forming station.

9. The packaging machine according to claim 1, further comprising a sealing station positioned downstream of the forming station for sealing the container.

10. The packaging machine of claim 1 wherein the forming station is configured to apply the overpressure directly to the film such that the gas contacts the film.

11. The packaging machine of claim 1 wherein the second proportional controller comprises a valve and control electronics that regulate the valve, and wherein the control electronics are configured to briefly open the valve completely at the onset of deformation of the film and, then, to adjust the pressure.

12. The packaging machine of claim 1 wherein the heating member comprises a heating plate.

13. A method for producing packages made of a film in a packaging machine comprising a forming station, the method comprising:

applying underpressure or overpressure to the film at the forming station to mold containers in the film; and controlling pressure and/or the volume flow of a gas with a proportional controller to develop the underpressure or the overpressure;

wherein the proportional controller comprises a value and control electronics that regulate the valve, and the controlling step is performed such that the control electronics open the valve completely at the onset of deformation of the film and then adjust the pressure.

14. The method according to claim 13, wherein the controlling step comprises controlling the valve as a function of a predetermined set pressure value and/or a set volume flow of gas value and a measured actual pressure value and/or actual volume flow of gas value with the control electronics.

15. The method according to claim 14, further comprising transmitting the predetermined set pressure value and/or the set volume flow of gas value by means of a machine control connected to the proportional controller.

16. The method according to claim 14, wherein the controlling step comprises limiting the pressure after briefly opening the valve completely at the onset of deformation.

17. The method according to claim 13, further comprising setting a predetermined pressure and/or volume flow of gas with a display and storing the predetermined pressure and/or volume flow of gas in a memory.

18. The method according to claim 13, further comprising readjusting the pressure and/or volume flow of the gas during the process.

19. The method according to claim 13, further comprising measuring the pressure currently available in the forming station.

20. The method according to claim 13, wherein the controlling step comprises limiting the pressure after briefly opening the valve completely at the onset of deformation.

21. The method according to claim 13, further comprising sealing the containers in a sealing station disposed downstream of the forming station.

22. The method according to claim 13 further comprising:

sealing the containers; and gassing the containers.

23. The method of claim 13 wherein the applying step comprises applying the overpressure directly to the film such that the gas directly contacts the film.

24. The method of claim 13 further comprising applying an initial underpressure or an initial overpressure to the film at the forming station to move the film in a first direction toward a heating member, and wherein the step of applying underpressure or overpressure directly to the film is performed such that the film moves in a second direction away from the heating member.

25. The method of claim 24 wherein the heating member comprises a heating plate.

* * * * *

UNITED STATES PATENT AND TRADEMARK OFFICE

CERTIFICATE OF CORRECTION

PATENT NO. : 8,091,322 B2
APPLICATION NO. : 12/217291
DATED : January 10, 2012
INVENTOR(S) : Elmar Ehrmann It is certified that error appears in the above-identified patent and that said Letters Patent is hereby corrected as shown below:

Column 6, Line 18, Claim 13:

After "proportional controller comprises a"
delete "value" and insert -- valve --.

Signed and Sealed this
Twenty-seventh Day of March, 2012

David J. Kappos

David J. Kappos
*Director of the United States Patent and Trademark Office*